US005334012A

United States Patent [19]

Brock et al.

[11] Patent Number: 5,334,012

[45] Date of Patent: Aug. 2, 1994

[54] COMBUSTION CHAMBER HAVING REDUCED $NO_x$ EMISSIONS

[75] Inventors: J. Don Brock; Erbie G. Mize, both of Chattanooga, Tenn.; Malcom L. Swanson, Chickamauga, Ga.

[73] Assignee: Astec Industries, Inc., Chattanooga, Tenn.

[21] Appl. No.: 682,750

[22] Filed: Apr. 9, 1991

Related U.S. Application Data

[63] Continuation-in-part of Ser. No. 633,334, Dec. 27, 1990.

[51] Int. Cl.[5] ..... F27B 7/02

[52] U.S. Cl. ..... 432/106; 110/244; 110/265

[58] Field of Search ..... 110/345, 346, 265, 211, 110/213; 432/106

[56] References Cited

U.S. PATENT DOCUMENTS

| | | | |
|---|---|---|---|
| Re. 29,496 | 12/1977 | Dydzky | 366/25 |
| 3,490,869 | 1/1970 | Helle . | |
| 3,592,596 | 5/1968 | Henderson . | |
| 3,787,562 | 1/1974 | Heller et al. . | |
| 3,963,416 | 6/1976 | Mach | 432/64 |
| 4,132,180 | 1/1979 | Fredrick | 110/244 |
| 4,143,972 | 3/1979 | Benson | 366/25 |
| 4,190,370 | 2/1980 | Brock et al. | 366/25 |
| 4,229,109 | 10/1980 | Benson | 366/24 |
| 4,309,113 | 1/1982 | Mendenhall | 366/4 |
| 4,332,478 | 6/1982 | Binz | 366/4 |
| 4,333,405 | 6/1982 | Michelfelder | 110/265 |
| 4,539,918 | 9/1985 | Beer et al. | 110/265 |
| 4,600,379 | 7/1986 | Elliott | 432/13 |
| 4,616,934 | 10/1986 | Brock | 366/25 |
| 4,838,185 | 6/1989 | Flament | 110/265 |
| 4,892,411 | 1/1990 | Elliott et al. | 366/25 |

OTHER PUBLICATIONS

McCabe & Smith, Unit Operations in Chemical Engineering 3rd ed. at 106–111.

The Operation of Exhaust Systems in the Hot Mix Batch Plant, published by The National Asphalt Pavement Association, pamphlet Feb. 1980.

Dryer Frum Mixer, technical paper.

Geankoplis, Transport Processes and Unit Operations, pp. 69–80.

*Primary Examiner*—Henry C. Yuen

*Attorney, Agent, or Firm*—Nilles & Nilles

[57] ABSTRACT

A combustion chamber having improved heating efficiency and reduced $NO_x$ emissions includes a reduced diameter throat and a stepped configuration within the chamber. The chamber configuration encourages efficient combustion to reduce $NO_x$ production by promoting the formation of eddy currents within the chamber. A method for increasing heating efficiency and reducing $NO_x$ production is provided and involves passing combustion gases through such a combustion chamber.

5 Claims, 4 Drawing Sheets

COMBUSTION CHAMBER HAVING REDUCED $NO_x$ EMISSIONS

CROSS REFERENCE TO RELATED APPLICATION

This is a continuation-in-part application of U.S. patent application Ser. No. 633,334, filed Dec. 27, 1990.

TECHNICAL FIELD

The present invention relates in general to a combustion chamber which more efficiently burns fuel with fewer undesirable emissions, and in particular to an improved combustion chamber useful for heating aggregate in an asphalt plant.

BACKGROUND ART

No single component is more important in the manufacture of hot mix asphalt than the aggregate dryer and its exhaust system. One problem encountered with the use of such apparatus is pollution in the form of $NO_x$ compounds produced by the burner flame. It is known that the formation of $NO_x$ compounds may be inhibited by more efficient combustion of the available fuel; reducing the amount of nitrogen in the fuel; reducing the flame temperature; reducing the amount of air available for combustion; and reducing the time that combustion gases spend at elevated temperatures.

It is common in the steam generation industry to lower flame temperature by recirculating flue gas to the burner and thereby reducing $NO_x$ emissions. This reduction in flame temperature is further augmented by staged combustion in which the flame is initially oxygen poor (and therefore cooler) and is charged with additional oxygen a short time later to complete combustion. Multiple stages are preferably utilized to obtain the best results.

Experience has taught, however, that methods useful in the steam industry for reducing the formation of $NO_x$ compounds are not applicable to equipment used in the production of asphaltic products, such as aggregate dryers. This is because the two processes utilize different types of flames to provide heat and because aggregate dryers generally are of a shorter dimension unsuitable for implementing staged combustion techniques having multiple stages. Steam generation plants typically utilize lengthy staged combustion and a flame characterized as long and lazy. Lengthy, multiple staged combustion set-ups and long, lazy flames cannot be used in aggregate dryers because aggregate dryers typically provide a smaller combustion area than do steam plants.

The recirculation of gases in rotary heating equipment for purposes other than to reduce the level of $NO_x$ is known in the art. U.S. Pat. No. 4,190,370 discloses a drum mixer having a temperature control system for regulating the temperature of the asphalt-aggregate mix by varying the flow of hot gases through the drum mixer. The system is also disclosed in connection with an aggregate dryer. The temperature control system withdraws gases exiting the drum before they pass through a baghouse and recirculates them to an input manifold on the drum mixer. This recirculation system reduces the temperature of the burner flame and the energy required to heat the gases within the drum mixer, but does not suggest any effect on $NO_x$ emissions.

U.S. Reissue Pat. No. Re. 29,496 discloses another rotary heating device in which combustion gases are recirculated from the outlet of a drum mixer to a burner assembly located at the inlet of the drum mixer. The recirculation gases are passed through a heating or a cooling heat exchanger before being routed to the burner. This recirculation scheme is said to provide a somewhat isothermal air flow to the burner and to allow more energy efficient operation, but the patent does not discuss any reduction in either flame temperature or flame length. Nor does the patent suggest that the scheme operates to reduce $NO_x$ emissions.

Other examples of rotary heating devices incorporating various gas recirculating schemes are disclosed in U.S. Pat. Nos. 3,963,416; 4,143,972; 4,309,113; 4,332,478; 4,600,379; and 4,892,411. However, none of these recirculation methods are directed to the reduction of $NO_x$ emissions.

Therefore, there remains a need for an improved rotary heating device for use in the production of asphaltic paving materials having reduced $NO_x$ emissions, and in particular for a combustion chamber which consumes fuel in a manner which results in fewer $NO_x$ emissions.

SUMMARY OF THE INVENTION

The present invention solves the above-discussed need in the art by providing an improved combustion chamber and a method of flowing gases through a combustion chamber which enhances the mixing of fuel and air to allow more efficient operation, to promote greater flame stability and to reduce the level of $NO_x$ emissions created in the combustion process.

Generally described, the present invention comprises a combustion chamber having improved heating efficiency and reduced $NO_x$ emissions, comprising an enclosure defining a first end and a second end, and capable of having a main current of gases flowing from the first end to the second end, the internal cross section of the enclosure including a throat positioned at the first end and having a first cross-sectional area; a first expansion adjacent and interior to the throat, having a cross-sectional area greater than the first cross-sectional area of the throat for promoting a vortexlike motion of gas flow within the enclosure which runs contrary to the main current in part of the first expansion; and a second expansion adjacent and interior to the first expansion having a cross-sectional area greater than the cross-sectional area of the first expansion for promoting a vortex-like motion of gas flow within the enclosure which runs contrary to the main current in part of the second expansion.

The present invention may also provide more than two expansions in the cross-sectional area of the chamber and is particularly useful when used in connection with aggregate dryers, but can also be used with other heating apparatus.

In another aspect of the present invention, there is provided a method for increasing heating efficiency and reducing $NO_x$ production in a combustion chamber, comprising the steps of introducing a main current of combustion gases into a first cross-sectional area; passing the main current of gases from the first cross-sectional area into a second cross-sectional area having a cross-sectional area greater than the first cross-sectional area such that a first portion of gases is separated from the main current and directed to run contrary to the main current in part of the second cross-sectional area;

and passing the main current of gases from the second cross-sectional area into a third cross-sectional area having a cross-sectional area greater than the second cross-sectional area such that a second portion of gases is separated from the main current and is directed to run contrary to the main current in part of the third cross-sectional area.

This method may also provide more than two expansions in the cross-sectional area and is particularly useful with combustion chambers used in connection with aggregate dryers, but can also be used with other heating apparatus.

Accordingly, it is an object of the present invention to provide an improved combustion chamber.

Another object of the present invention is to provide a combustion chamber which minimizes the amount of $NO_x$ emissions associated with its operation.

It is yet another object of the present invention to provide a combustion chamber which reduces the production of $NO_x$ compounds by influencing the flow of gases through the chamber.

A further object of the present invention is to provide a combustion chamber having flow characteristics which increase the proportion of the volume of the chamber having turbulent flow.

A still further object of the present invention is to provide a combustion chamber which provides the formation eddy currents within the combustion chamber to improve heating efficiency, promote flame stability and reduce $NO_x$ emissions.

Yet another object of the present invention is to provide an aggregate dryer having reduced $NO_x$ emissions.

Still another object of the present invention is to provide a method for increasing the heating efficiency and reducing the production of $NO_x$ of a combustion chamber.

These and other objects, features and advantages of the present invention will become apparent from a review of the following detailed description of the disclosed embodiment and the appended drawings and claims.

DETAILED DESCRIPTION OF THE PREFERRED EMBODIMENT

Figure 1:
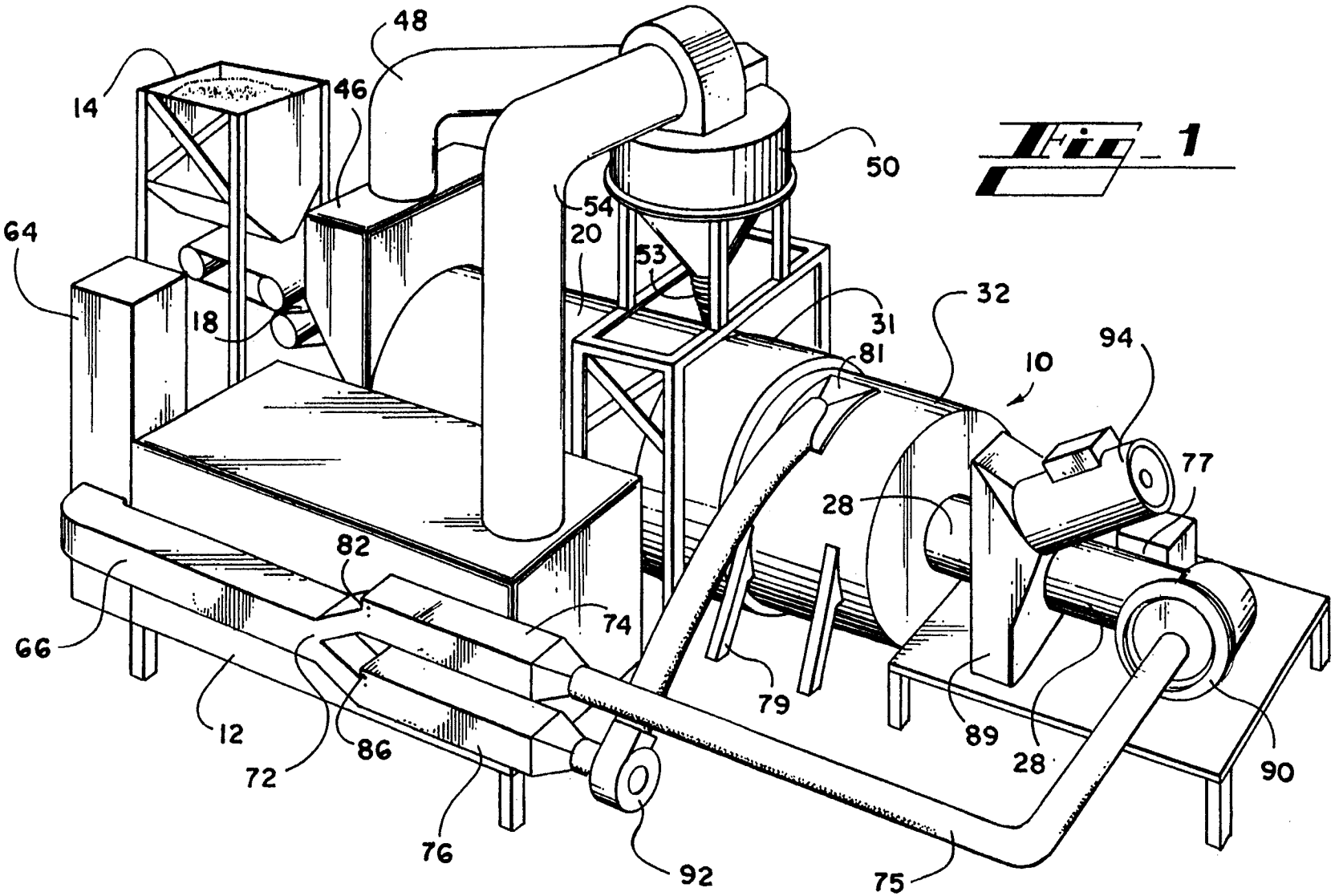
FIG. 1 is a perspective view of a preferred embodiment of the present invention.

Referring to the drawings, in which like numerals indicate like parts, throughout the several views, FIG. 1 shows a counter-flow aggregate dryer 10 adjacent a baghouse 12 and a virgin aggregate bin 14. The aggregate is fed by a conveyor belt 18 from the bin 14 for delivery into the dryer 10 in a manner well known in the art. The baghouse 12 filters gases which have passed through the dryer 10, also in a conventional manner.

Figure 2:
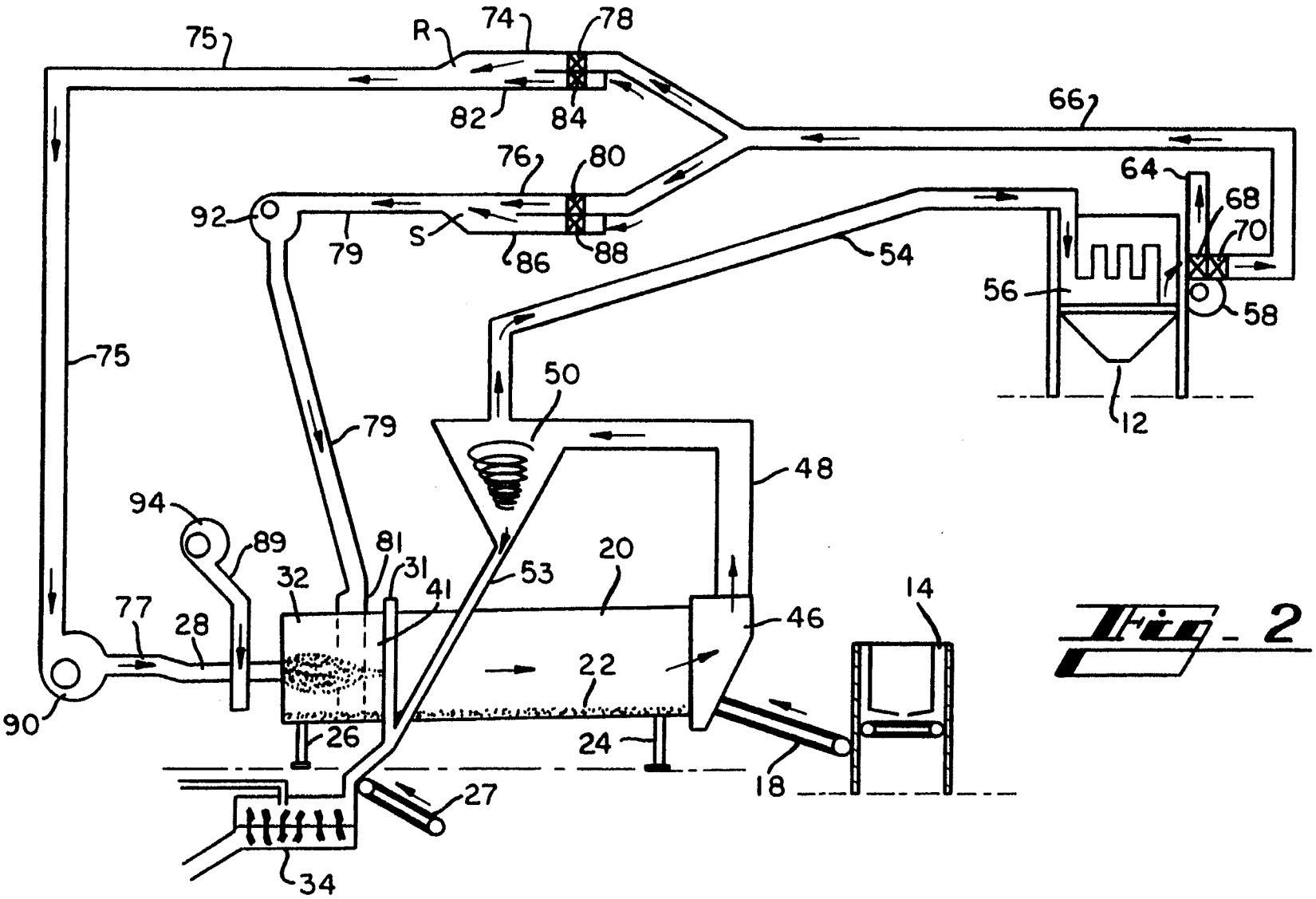
FIG. 2 is a schematic diagram of the device shown in FIG. 1.

Referring now to FIGS. 1 and 2, the dryer 10 includes an elongate drum 20 rotatably mounted on a support frame 22. Pivotally attached at one end of the support frame 22 are a pair of support legs 24. Attached at the other end of the support frame 22 are a pair of extendable support legs 26. The length of the legs 26 may be adjusted by various methods known in the art, but preferably hydraulically. In their unextended configuration, the legs 26 are generally of a shorter length than the legs 24, which are adjacent to the aggregate feed conveyor 18. In this configuration, the drum 20 is mounted at an angle inclined from horizontal. As the legs 26 are extended, the angle of inclination of the drum 20 is reduced. However, it is desirable that the drum 20 always be maintained at some inclined angle so that material fed into the drum by the conveyor 18 will feed down the length of the drum 20 due to the affect of gravity as the drum is rotated. The adjustability of the legs 26 therefore provides a means for controlling the rate at which material will feed down the length of the drum 20 at a particular rate of rotation of the drum.

Located at the lower end of the dryer 10 is a flame source, such as a conventional gas burner 28. The burner 28 projects a flame 30 having a temperature of between about 2,200° and 3,000° F. into a refractory combustion chamber 32, shown in more detail in FIG. 3. A discharge manifold 31 is located between the refractory combustion chamber 32 and the drum 20 for discharge of heated aggregate to a hot mix pugmill coater 34 located adjacent the dryer. The hot mix coater 34 is of known construction and operation, as shown in U.S. Pat. No. 4,616,934, incorporated herein by reference.

The pugmill coater 34 is positioned adjacent to and below the combustion chamber 32 with its longitudinal axis sloping with respect to horizontal. The lower end 29 of the pugmill coater is disposed below and adjacent to the discharge manifold 31 so that the dried aggregate from the dryer 10 falls by gravity directly into the pugmill coater 34. Recyclable material may also be introduced into the pugmill coater by a recycle conveyor 27, in a manner well known in the art and recovered fines may also be introduced through a particle return duct 53, described below. Conventional apparatus for heating and conveying liquid asphalt to the pugmill coater is also provided.

Figure 3:
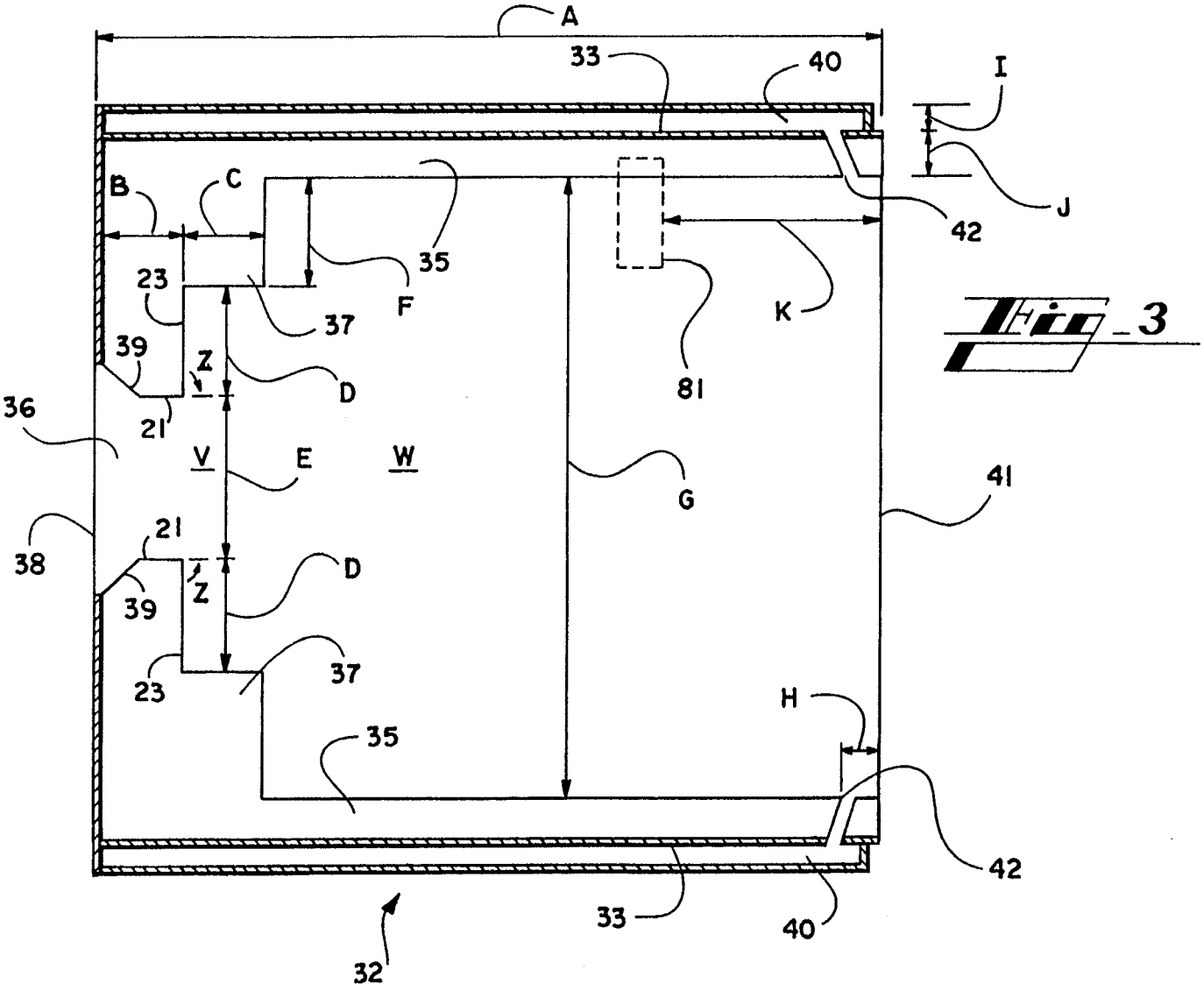
FIG. 3 is a cross-sectional view of the combustion chamber of FIG. 1.
Figure 4:
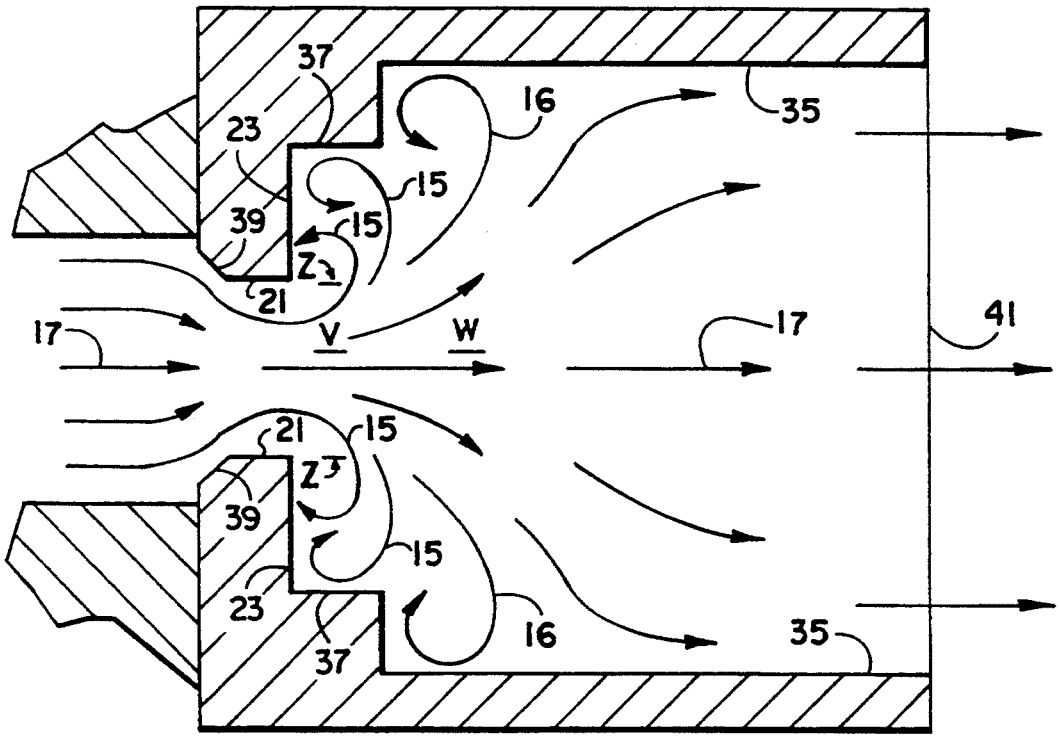
FIG. 4 is a diagrammatic cross-sectional view of the combustion chamber showing the flow pattern of gases through the chamber.

Referring now to FIGS. 3 and 4, the refractory combustion chamber 32 is a stepped chamber designed to aid the mixing of recirculated gases and reduce $NO_x$ emissions, as explained below. The combustion chamber 32 is preferably a steel shell 33 lined with a castable refractory material 35 such as Greencast 97-L available from A. P. Greencast, Mexico, Mo. To provide a more turbulent flame 30, the chamber 32 is configured to have a stepped configuration including a reduced diameter throat 36 at a first or exterior end 38 of the chamber located closest to the burner 28 and a step 37 located downstream of the throat. The throat has an annular surface 21 which forms a flowpath for gases through the throat. A radially extending, annular connecting surface 23 connects the throat to the expanded cross-sectional area provided by the step 37.

Referring further to FIG. 3, the following measurements set forth in Table 1 illustrate the preferred dimensions of the interior of the chamber 32. It should be noted however, that it is the general relative dimensions provide the preferred flow characteristics.

TABLE 1

| Distance | Approximate Measurement (ft) |
|---|---|
| A | 8.0 |
| B | 1.0 |
| C | 1.0 |

TABLE 1-continued

| Distance | Approximate Measurement (ft) |
|---|---|
| D | 1.5 |
| E | 2.0 |
| F | 1.0 |
| G | 8.0 |
| H | 0.5 |
| I | 0.5 |
| J | 0.5 |
| K | 3.5 |

The reduced throat and stepped construction allows, on its own, for decreased $NO_x$ production with increased efficiency and drying capabilities. The chamber construction provides enhanced mixing of fuel and air which results in a more turbulent, more stable flame. The shape of the chamber also creates back-swirl or eddy currents 15 and 16 as shown in FIG. 4 which aid in the mixing of combustion gases.

Referring further to FIG. 4, there is shown a main current 17 of gases entering the combustion chamber through the throat 36. A beveled surface 39 is provided at the throat entrance to reduce the effect of the sudden contraction of the throat on the flow of gas. The beveled surface 39 eliminates the sharp comer that would otherwise be present to induce vortice formation along the inner surface of the throat. Such vortices would promote better mixing of gases, but would also increase the pressure drop through the throat to an undesirable level for the present embodiment. The throat of the embodiment shown in FIG. 3 has a pressure drop of about 8 inches water gauge. It will be understood, however, that for some applications the beveled surface 39 may be omitted. Additionally, for some applications, a beveled surface (not shown) may be provided on the throat exit to alter flow characteristics. As shown in FIG. 4, an angle Z exists between the throat surface 21 and the connecting surface 23 and has a value of about 90°. It will be understood that the angle Z is not necessarily a 90° angle and need not form a sharp corner at this point. The most important characteristic of the chamber is the provision of successive enlargements of the cross-sectional area to promote the formation of vortexlike currents which run contrary to the main current to allow better mixing of the combustion gases. However, by making the throat surface 21 a beveled surface or inclining the surface 23 and thus reducing angle Z preferably not to less than about 7°, vortice formation along the connecting surface 23 may also be induced. Likewise, it will also be understood that the step 37 need not be a 90° comer.

In the embodiment of FIG. 4, the velocity of the main current 17 of gases increases during passage through the throat 36. Upon exiting the throat, the main current 17 encounters successive enlargements of the cross-sectional area of the chamber 32 and experiences a decrease in velocity. When the main current encounters a first expansion V of the cross-sectional area created by the step 37 wherein the diameter of the chamber increases from E to 2D+E (shown in FIG. 3), a portion of the flow separates from the main current into a first set of eddy currents 15 which are drawn toward the perimeter of the chamber and run contrary to the main current in the outer parts of the first expansion V. As the main current progresses toward a second expansion W of the cross-sectional area downstream and adjacent the step 37 wherein the diameter increases from 2D+E to G, an additional portion of the flow separates from the main current into a second set of eddy currents 16 which are drawn towards the perimeter of the chamber in the second area of expansion and run contrary to the main current in this area. It will be appreciated that the flow characteristics of the main current may be different along the length of the chamber, as the eddy currents formed in each area serve to alter the flow of the main current.

The formation of eddy currents is known to occur whenever a flow encounters a sudden increase in cross-sectional area. It has been observed, however, that by shaping the interior of the chamber such that the cross-sectional area of the chamber is increased in successive steps rather than all at once, the efficiency of the chamber is increased. For example, it has been experienced that a combustion chamber made in accordance with the measurements of Table 1 enhances heating efficiency by allowing more complete combustion. Visual observations of a flame within a combustion chamber made in accordance with Table 1 indicates more complete combustion as evidenced by the chamber having a translucent volume without distinguishable, individual flame edges. It is believed that this increase in flame stability and efficiency results from enhanced formation of eddy currents, as shown in FIG. 4, which result from the combination of the reduced diameter throat and stepped configuration of the chamber.

To further reduce $NO_x$ emissions, gases may be introduced to the end of the flame to act in a "quenching" manner or to provide an abbreviated version of staged combustion. The steel shell 33 of the chamber 32 is surrounded by an annular duct 40 which is supplied with recirculated gases in a manner described below. A series of quenching holes or nozzles 42 extend through the refractory material 35 to communicate with the interior of the chamber 32 at a second end 41 of the chamber which opens to the drum 20. The nozzles 42 provide a "quenching ring" for introducing cooler exhaust gases to cool and reduce the length of the flame or may be used as conduits for adding air for staged combustion. As will be explained further, the annular duct 40 is preferably adapted to conduct recirculated gases through the nozzles 42 and direct them generally toward the center of the chamber at a velocity sufficient to penetrate the flame 30. This further promotes turbulence and mixing of the recirculated gases with the end of the flame 30 and reduces the temperature and length of the flame. Experience has taught that a velocity of about 10,000 feet per minute is suitable and may be obtained using a fan or blower generating a pressure of about 16 inches $H_2O$ through thirty-six uniformly spaced 2 inch diameter nozzles.

The heated gases from the burner 28 pass from the chamber 32 into the drum 20 to heat and dry the virgin aggregate 14. An exhaust manifold 46 is provided at the upper end of the drum 20 for conducting gases from the drum 20. The exhaust manifold 46 is connected to a separator duct 48 for conducting gases and suspended particulate matter (such as small aggregate particles) away from the exhaust manifold. The duct 48 leads to a conventional cyclone separator 50 located above the drum 20 for removal of particulate matter, such as aggregate fines, from the exhaust gases. The removed particulate matter is conducted to the pugmill coater 34 by a particle return duct 53 which leads from the bottom of the cyclone separator 50 to the pugmill coater 34. A baghouse duct 54 conducts the separated gases to the baghouse 12 for further particulate removal.

The baghouse 12 is of a design well known in the art and includes an internal filter chamber 56 within which extend a number of fiber filter collectors in the form of filter bags (not shown). Air How through the baghouse 12 is provided by an exhaust fan 58 having an inlet duct connected to a plenum chamber of the baghouse (not shown). The output of the exhaust fan 58 is connected to an exhaust stack 64 which opens to the atmosphere. A recirculating duct 66 is connected to the exhaust stack 64 for routing an amount of the exhaust gases through the recirculating duct. A manual diverter damper 68 is provided on the exhaust stack 64 to route a percentage of the exhaust gases to the recirculating duct 66 according to the damper setting. A modulating control damper 70 is provided on the recirculating duct to vary the flow of gases through the recirculating duct 66 in proportion to the fuel flow to the burner 28. The modulating control damper 70 receives a control signal from a burner controller (not shown) of a type which is well known in the art for controlling the amount of fuel and air introduced to the burner 28. The modulating controller may be calibrated and operated to provide a flow consistent with the values set forth in Tables 2 and 4.

The exhaust gases routed to the recirculating duct 66 may be routed to the burner 28 or to the quenching nozzles 42, or both. A "Y" duct 72 is provided along the recirculating duct 66 to permit the desired routing of the exhaust gases, as explained below.

The recirculating duct 66 is split at the "Y" duct 72 into a primary exhaust gas recirculating ("EGR") feed duct 74 and a quenching EGR feed duct 76. Manual control dampers 78 and 80 are provided on the primary EGR feed duct 74 and the quenching EGR feed duct 76, respectively. Manipulation of the dampers 78 and 80 allows the desired amount of exhaust gas to be routed through each of the ducts 74 and 76. A primary ambient air duct 82 having a manual control damper 84 and a staging ambient air duct 86 having a manual control damper 88 are provided just downstream of the "Y" duct 72 for introducing ambient air to the primary air feed duct 74 and the quenching air feed duct 76, respectively. The flow rates of gases through each of the ducts 74, 76, 82 and 86 are preferably monitored utilizing conventional pitot tube apparatus (not shown) downstream of the dampers 78, 80, 84 and 88, respectively.

Additionally, it will be understood that each of the manual control dampers 68, 78, 80, 84 and 88 may be replaced with electronic control dampers, whose operation may be controlled responsive to signals from the pitot tubes, utilizing conventional microprocessor equipment well known in the art for automatic process control.

The contributions of the primary EGR feed duct 74 and the primary ambient air duct 82 are combined at point R to form a primary EGR duct 75. Likewise, the contributions of the quenching EGR feed duct 76 and the staging ambient air duct 86 are combined at point S to form a quenching EGR duct 79. The primary EGR duct 75 extends to a conventional primary air inlet 77 on the burner 28. For combustion to occur, air and fuel must be supplied to the burner 28 in appropriate amounts. Combustion air is defined as the air or gases required for complete combustion of the available fuel. Excess air is defined as the air or gases supplied in addition to the combustion air. Combustion and excess air may be supplied to the burner 28 utilizing the primary EGR duct 75 and/or a tertiary air duct 89. A primary fan 90, and a tertiary fan 94 are provided along each of the respective ducts 75 and 89 to render available the desired amount of gases from each duct. The quenching EGR duct 79 extends via an inlet duct 81 to communicate with the annular duct 40 of the combustion chamber. A quenching fan 92 is provided along the quenching EGR duct 79 to transmit the desired amount of gases through the quenching EGR duct 79. To obtain the maximum flow rates shown in Example 1 below, a 100 horsepower centrifugal fan was utilized for the primary fan 90; a 40 horsepower centrifugal fan was utilized for the quenching fan 92; and a 150 horsepower axial flow fan was utilized for the tertiary fan 89.

The dryer 10 operates as follows. A continuous supply of virgin aggregate is introduced into the drum 20 by the conveyor 18. The flame 30 from the burner 28 provides combustion gases to the refractory combustion chamber 32. These gases exit the drum 20 via the exhaust manifold 48 and are routed to the cyclone separator 50 for removal of particulate matter and then to the baghouse 12 for further removal of particulate matter.

It is noted that gases exiting the baghouse 12 are more humid and at a lower temperature than gases within the dryer 10. The present invention uses these cooler, moister gases emerging from the baghouse 12 to accomplish a reduction in the formation of $NO_x$ compounds. The dryer 10 thereby is a conventional counter-flow aggregate dryer except for the novel features described herein.

It is found that combustion efficiency may be improved, and hence $NO_x$ production may be reduced, by providing a stepped configuration within the combustion chamber which promotes the formation of eddy currents. It is also found that $NO_x$ emissions may be reduced by maintaining a highly turbulent, short flame 30 while reducing the maximum temperature of the flame and the time that the gases spend at a temperature where $NO_x$ is readily created. The dryer 10 operates to produce this second set of conditions by taking the gases from downstream of the exhaust fan 58 and recirculating them to the burner 28 via the primary EGR duct 75 and to the end of the flame 30 via the quenching duct 79, as discussed above. While it will be understood that ambient air or gases recirculated from the exhaust manifold 46 may be used, it is preferred to use air recirculated from after the baghouse 12. Additional benefits of using air recirculated from after the baghouse 12 include the elimination of the back-flow of excessively hot furnace gases through the primary fan 90 and the quenching fan 92, and the elimination of dust loading from the fans 90 and 92.

A flow of recirculated gases through the primary EGR duct 75 and the quenching duct 79 may be established by the primary fan 90 and the quenching fan 92, respectively. These moister, cooler recirculated gases are routed to the burner 28 by the primary EGR duct 75 and to the end of the flame 30 via the quenching EGR duct 79 which directs gases to the nozzles 42. Introduction of recirculated gases to the burner 28 and the quenching ring 38 reduces the flame temperature, the flame length, and the free oxygen content. These reductions result in a lower rate of $NO_x$ production. As stated before, it is preferable to recirculate gases from after the baghouse 12, because the gases are cleaner and less damaging to the blowers 90 and 92. The trade-off for this benefit of cleaner gases is the disadvantage of a more oxygen rich and cooler recirculation gas stream, because baghouse filtration increases oxygen content. It will be understood that a less oxygen rich exhaust gas stream may be obtained by recirculating the exhaust gas from before the baghouse 12. This, however, has the disadvantage of a more dust laden gas stream.

The amount of exhaust gas recirculated is determined as a mass percentage of the "total gases" supplied by the Primary EGR duct 75, the quenching EGR duct 79, and the tertiary air duct 89. Combustion air is the amount of air or gases needed for combustion of the available fuel. Excess air is the amount of air or gases supplied in excess of the combustion air.

In the preferred operation of the dryer 10, all of the combustion air and some of the excess air is supplied by the primary EGR duct 75 in combination with the tertiary air duct 89). In this mode, the quenching EGR duct 79 supplies exhaust gases to the nozzles 42 at a velocity sufficient to penetrate the flame 30.

As stated above, the term "total gases" is defined as the sum of all recirculated gases and fresh air supplied by the primary EGR duct 75, the quenching EGR duct 79, and the tertiary air duct 89. In the preferred operating mode, the contributions and compositions of the various gases and air ducts preferably fall within the following ranges set forth in Table 2.

TABLE 2

| Duct | Description | Approximate % by mass of total gases | Approximate % by mass in duct which is recirculated gas |
|---|---|---|---|
| 66 | Recirculation | 5 to 50 | 100 |
| 74 | Primary EGR Feed | 0 to 95 | 100 |
| 82 | Primary ambient air | 0 to 95 | 0 |
| 75 | Primary EGR | 28 to 95 | 5 to 100 |
| 76 | Quenching EGR Feed | 5 to 30 | 100 |
| 86 | Staging Ambient Air | 0 | 0 |
| 79 | Quenching EGR | 5 to 30 | 100 |
| 89 | Tertiary Air | 0 to 67 | 0 |

TABLE 2

| Duct | Description | Approximate % by mass of total gases | Approximate % by mass in duct which is recirculated gas |
|---|---|---|---|
| 66 | Recirculation | 5 to 50 | 100 |
| 74 | Primary EGR Feed | 0 to 95 | 100 |
| 82 | Primary ambient air | 0 to 95 | 0 |
| 75 | Primary EGR | 28 to 95 | 5 to 100 |
| 76 | Quenching EGR Feed | 5 to 30 | 100 |
| 86 | Staging Ambient Air | 0 | 0 |
| 79 | Quenching EGR | 5 to 30 | 100 |
| 89 | Tertiary Air | 0 to 67 | 0 |

EXAMPLE 1

The below Table 3 sets forth maximum flow rates anticipated to be utilized to perform tests of a dryer embodying the invention. The results of the planned tests are expected to indicate an average reduction in $NO_x$ emissions, as measured at the exhaust stack 64, from approximately 0.024 pounds per ton of aggregate to approximately 0.158 pounds per ton of aggregate.

TABLE 3

| Duct | Description | Maximum Flow Rate cubic feet per min. at 60° F. and 1 atm | Actual Operating Temp (°F.) | Actual Operating Pressure (inch $H_2O$) |
|---|---|---|---|---|
| 64 | Exhaust to Atmosphere | 44,750 | 250 | −5.0 |
| 66 | Recirculation | 13,350 | 250 | −5.0 |
| 74 | Primary EGR Feed | 10,146 | 250 | −5.0 |

TABLE 3-continued

| Duct | Description | Maximum Flow Rate cubic feet per min. at 60° F. and 1 atm | Actual Operating Temp (°F.) | Actual Operating Pressure (inch $H_2O$) |
|---|---|---|---|---|
| 82 | Primary Ambient Air | 10,146 | ambient | −0.1 |
| 75 | Primary EGR | 10,680 | 250 | −5.0 |
| 76 | Quenching EGR Feed | 8010 | 250 | −5.0 |
| 86 | Staging Ambient Air | 0 | ambient | −0.1 |
| 79 | Quenching EGR | 8010 | 250 | −5.0 |
| 89 | Tertiary Air | 16,020 | ambient | −0.1 |

The above description discloses a mode of operation in which sufficient oxygen is provided to the burner 28 to allow complete combustion. The gases supplied by the quenching nozzles 42 are provided to reduce flame temperature and length. It will be understood, however, that other modes of operation may be practiced to reduce flame temperature and length. For example, the flow rates and the percentage of recirculated gases and fresh air in each duct may be varied to achieve the desired effects. For example, an abbreviated form of staged combustion may be accomplished by supplying insufficient combustion air to the burner. The remaining air required for combustion of the available fuel may then be supplied by the quenching nozzles 42. When operating in the staged combustion mode, the contributions and compositions of the gases and air ducts preferably fall within the ranges given in Table 4:

TABLE 4

| Duct | Description | Approximate % by mass of total gases | Approximate % by mass in duct which is recirculated gas |
|---|---|---|---|
| 66 | Recirculation | 0 to 30 | 100 |
| 74 | Primary EGR Feed | 0 to 95 | 100 |
| 82 | Primary Ambient Air | 0 to 95 | 0 |
| 75 | Primary EGR | 28 to 95 | 0 to 100 |
| 76 | Quenching EGR Feed | 0 | 100 |
| 86 | Staging Ambient Air | 5 to 30 | 0 |
| 79 | Quenching EGR | 5 to 30 | 0 |
| 89 | Tertiary Air | 0 to 67 | 0 |

It will further be noted that the novel design of the combustion chamber 32 is capable of reducing $NO_x$ emissions independent of the introduction of recirculated gas or staged combustion. This result occurs because of the superior mixing of fuel and air obtained by the geometry of the chamber. Thus, the duct 40 and nozzles 42 may be eliminated in some applications. However, if recirculated gases are provided, the chamber geometry aids in mixing recirculated gases with fuel and air.

While the foregoing description relates to a counterflow aggregate dryer, it will also be understood that the foregoing invention may also be utilized to reduce $NO_x$ emissions in connection with parallel flow dryers drum mixers, and other heating apparatus.

The foregoing description relates to preferred embodiments of the present invention, and modifications or alterations may be made without departing from the spirit and scope of the invention as defined in the following claims.

We claim:

1. A method for increasing heating efficiency and reducing $NO_x$ production in a heat source for generating heating gases to be passed into contact with a material to be heated, comprising the steps of:

introducing a main current of combustion gases into a first cross-sectional area;

passing said main current of gases from said first cross-sectional area into a second cross-sectional area having a cross-sectional area greater than said first cross-sectional area such that a first portion of gases is separated from said main current and directed to run contrary to said main current in part of said second cross-sectional area and passing said main current of gases from said second cross-sectional area into a third cross-sectional area having a cross-sectional area greater than said second cross-sectional area such that a second portion of gases is separated from said main current and is directed to run contrary to said main current in part of said third cross-sectional area; and said heat source defining a first end and a second end thereon, said main current of gases flowing from said first end to said second end, wherein said heat source further comprises means for introducing gases into said heat source adjacent to said second end.

2. The method of claim 1, wherein said means for introducing gases comprises an annular duct having a plurality of nozzles positioned in proximity to said second end to communicate with an interior portion of said heat source.

3. A method for increasing heating efficiency and reducing $NO_x$, production in a heat source for generating heating gases to be passed into contact with a material to be heated, comprising the steps of:

introducing a main current of combustion gases into a first cross-sectional area:

passing said main current of gases from said first cross-sectional area into a second cross-sectional area having a cross-sectional area greater than said first cross-sectional area such that a first portion of gases is separated from said main current and directed to run contrary to said main current in part of said second cross-sectional area;

passing said main current of gases from said second cross-sectional area into a third cross-sectional area having a cross-sectional area greater than said second cross-sectional area such that a second portion of gases is separated from said main current and is directed to run contrary to said main current in part of said third cross-sectional area;

the step of passing said main current of gases from said third cross-sectional area into one or more additional, consecutive expansions, each of said additional expansions having a cross-sectional area greater than its preceding expansion for promoting vortexlike motions of gas flow within said enclosure which run contrary to said main current in part of each expansion; and said heat source defining a first end and a second end thereon, said main current of gases flowing from said first end to said second end, wherein said heat source further comprises means for introducing gases into said heat source adjacent to said second end.

4. The method of claim 3, wherein said means for introducing gases comprises an annular duct having a plurality of nozzles positioned in proximity to said second end to communicate with an interior portion of said heat source.

5. The method of claim 4, wherein said introduced gases penetrate and quench a flame in said heat source.

* * * * *